US005244078A

United States Patent [19]

Silva et al.

[11] Patent Number: 5,244,078

[45] Date of Patent: Sep. 14, 1993

[54] SELECTIVE GRIPPER RELEASE

[75] Inventors: Robert M. Silva, Milford, N.J.; Frank J. Tomko, Bethlehem, Pa.

[73] Assignee: Graphic Management Associates, Inc., Del.

[21] Appl. No.: 4,174

[22] Filed: Jan. 13, 1993

Related U.S. Application Data

[63] Continuation of Ser. No. 852,675, Mar. 17, 1992, abandoned.

[51] Int. Cl.[5] ..... B65G 43/08

[52] U.S. Cl. ..... 198/464.3; 198/477.1; 198/483.1; 198/803.7

[58] Field of Search ..... 198/477.1, 464.3, 483.1, 198/803.7, 470.1, 365, 366, 370

[56] References Cited

U.S. PATENT DOCUMENTS 4,185,733 1/1980 Heikinheimo ..... 198/477.1 X
4,746,007 5/1988 Houseman ..... 198/470.1
4,801,132 1/1989 Reist ..... 198/470.1 X
4,905,818 3/1990 Houseman ..... 198/470.1 X
4,968,081 11/1990 Beight et al. ..... 198/470.1 X

*Primary Examiner*—D. Glenn Dayoan
*Attorney, Agent, or Firm*—Jordan B. Bierman

[57] ABSTRACT

A selective release for grippers on a conveyor, each of which has a movable arm and a stationary arm. Arms move toward each other to grip a planar product (e.g. a newspaper) therebetween and move away from each other to release the product. The gripper is biased toward the closed position and can be moved into the open position by the application of a release force. A rocker cam is provided which can move into a position whereby it urges the movable gripper arm into the open position and into contact with a retaining cam. The retaining cam holds the movable arm in the open position for a period of time sufficient to allow the product to be completely released from the gripper.

24 Claims, 6 Drawing Sheets

SELECTIVE GRIPPER RELEASE

This application is a continuation of application Ser. No. 07/852,675, filed Mar. 17, 1992, now abandoned.

The present invention is directed to a device for releasing individual, generally planar products from grippers holding them. More specifically, the device is intended for use in connection with the conveyance of printed products such as newspapers.

BACKGROUND OF THE INVENTION

Newspapers come off the press at approximately 75,000 copies per hour. Thereafter, the products themselves, or sections to be inserted therein, must be carried to various pieces of equipment for further processing. This is usually done by means of a chain conveyor on which are mounted a plurality of grippers. The grippers clamp the edge of the newspaper and hold it securely. When it is to be delivered to the next machine for processing, it is necessary to release the grippers.

However, due to the high speed at which they move, coupled with the reaction time of previously known devices, it is difficult to reliably release the papers and deposit them on a belt or other carrier for the next process step.

BRIEF DESCRIPTION OF THE INVENTION

The present invention is intended to overcome the foregoing difficulties; namely, to accurately and reliably open the grippers at the proper point so as to deposit the papers at the proper time and in the appropriate location. While the invention will be described in terms of the handling of folded newspapers, it is to be understood that it is applicable to any planar (preferably flexible) product.

In essence, the release of the present invention is intended to be used in connection with grippers which clamp a newspaper between a first arm and a second arm. The grippers are spring biased toward the closed position and may be opened by pressure on a release arm connected to the movable gripper arm.

There is at least one retaining cam which is adapted to bear against the gripper and hold it in the open position. This is necessary because it takes a finite amount of time for the newspaper to drop out of the gripper arms. Since the speed is very high (more than 20 copies per second), merely opening the gripper would not allow this to occur.

The gripper release is actuated by a rocker arm which has an operative position, wherein it urges the gripper into the open position and into contact with the retaining cam, and a closed position, wherein it is inactive and does not cause the gripper to open.

Since the reaction time of the mechanism may be virtually equal to the time between successive grippers, it has been found advantageous to provide a means to open every second gripper. This provides additional time and insures that the operation is carried out reliably.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
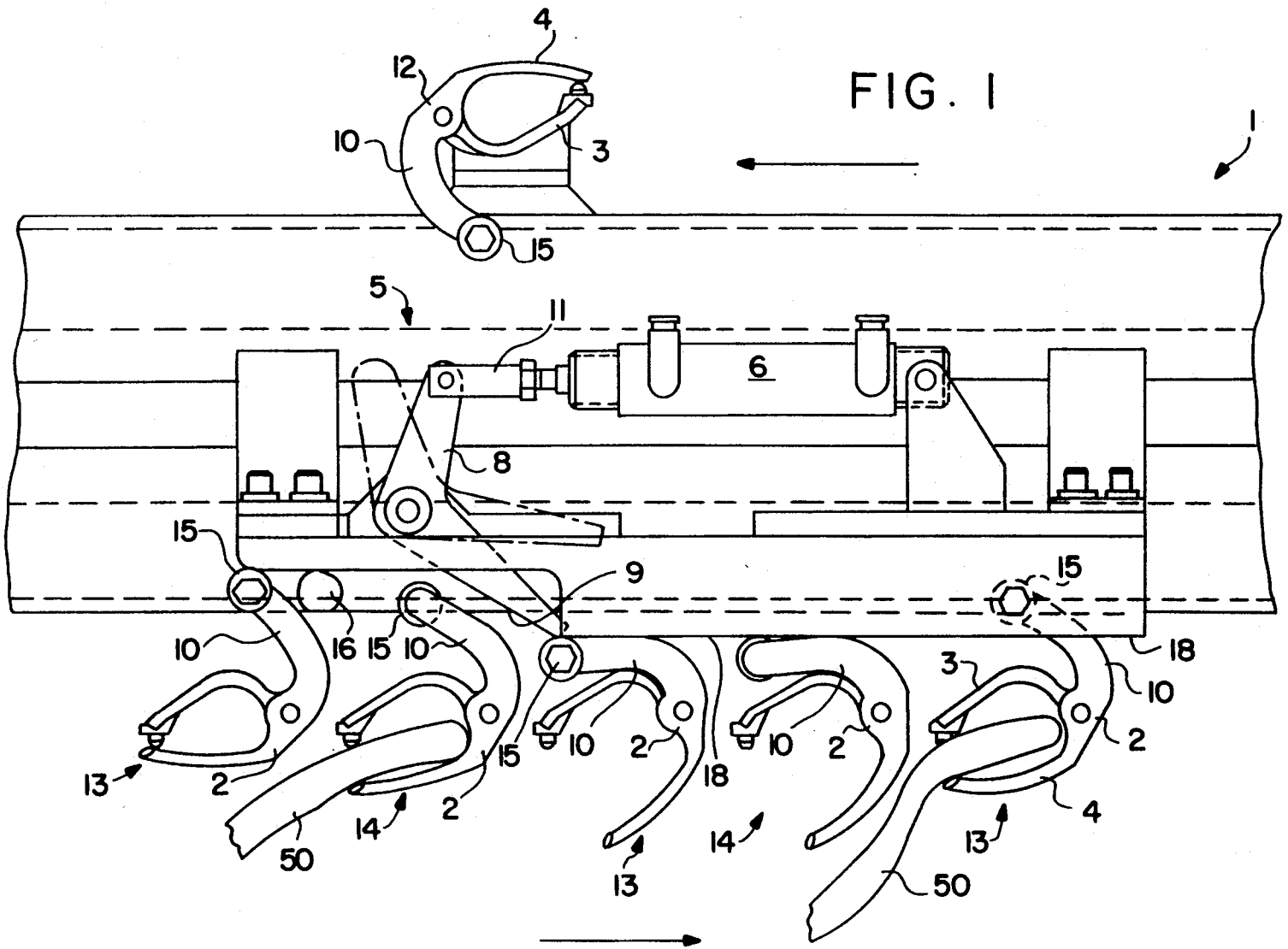
FIG. 1 is a schematic side view of the release of the present invention with some parts omitted for clarity.
Figure 2:
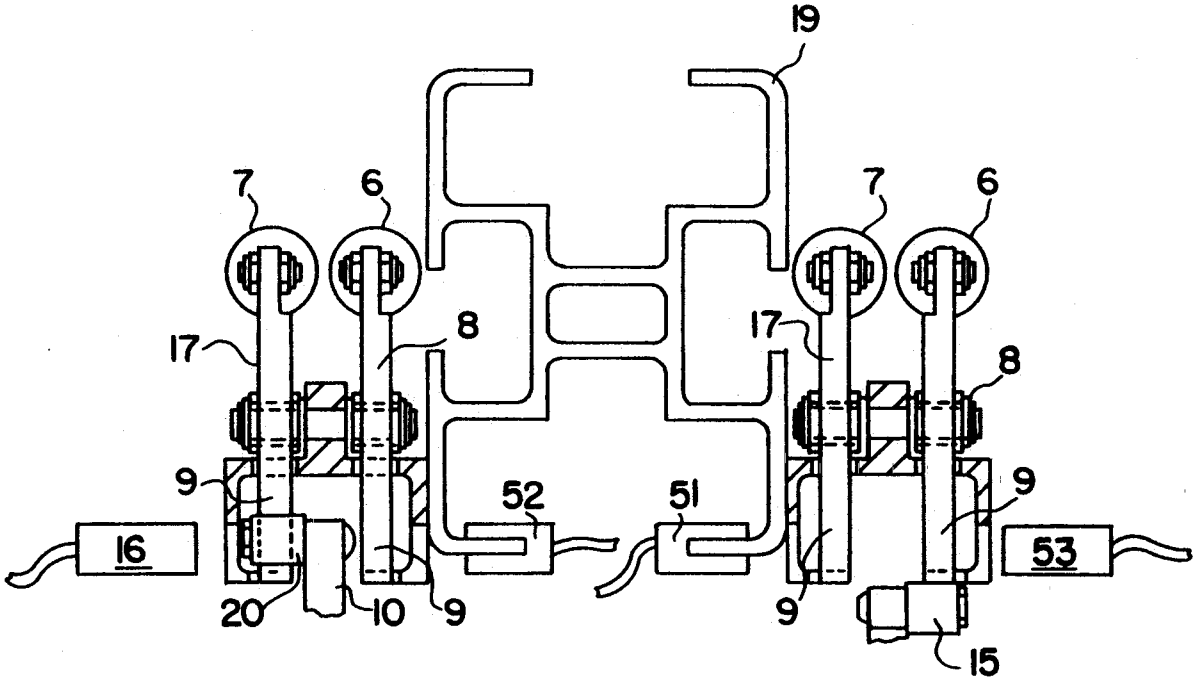
FIG. 2 is a schematic sectional view from the left side of FIG. 1 with some parts omitted for clarity.

Referring more specifically to FIGS. 1 and 2, conveyor 1 is provided with a plurality of grippers 2. Each gripper 2 comprises fixed arm 3, movable arm 4, and a pair of release arms 10, one located on each side of gripper 2.

There are release rollers 15 and 20 mounted on the distal end of release arms 10. To accommodate the ability to release alternate grippers, first alternate grippers 13 have rollers 15 which project to the right as shown in FIG. 2. Second alternate grippers 14 have rollers 20 which project to the left as shown in FIG. 2. Complementary to rollers 15 and 20 are pairs of rocker cams 8 and 17, actuated by corresponding pairs of solenoids 6 and 7. Each rocker arm 8 and 17 has cam surface 9 thereon.

In operation, as grippers 2 travel along conveyor 1, a signal is given to release certain selected grippers. At the appropriate time, solenoids 6 or 7 are activated, thereby moving rocker cams 8 or 17 into their operative position. If the gripper to be released is one of first alternate grippers 13, solenoids 6 (and hence rocker cams 8) are actuated; on the other hand, if the gripper selected is one of second alternate grippers 14, then solenoids 7 (and hence rocker cams 17) are activated.

In the case of the selected gripper being a first alternate gripper 13, solenoids 6 are activated to cause rocker cams 8 to assume the operative position as shown in full lines in FIG. 1. Roller 15, contacting cam surface 9 of rocker cam 8 is forced downward (as shown in FIG. 1) and beneath retaining cam 18. As it continues to move, retaining cam 18 holds the gripper open so that paper 50 has an opportunity to drop out.

Because of the high speed of conveyor 1 (necessitated by the press speed), it has been found advantageous to release alternate grippers, thereby doubling the amount of time which the mechanism has in which to assume the operative position and then return to the inoperative position. To facilitate this, as previously indicated, first alternate grippers 13 have rollers 15 extending to the right as shown in FIG. 2. Second alternate grippers 14 are provided with rollers 20 which extend in the opposite direction. In FIG. 2, the device is shown releasing all of grippers 2. Thus, pairs of solenoids 6 and 7 (and hence rocker cams 8 and 17) are shown in operative position. Roller 15 has just completed its contact with cam surface 9 of rocker arms 8. The other roller 15 is not shown. At the same time, roller 20 on second alternate gripper 14 is approaching cam surface 9 of rocker cam 17. At the point shown, it has not yet been forced downward.

Figure 3:
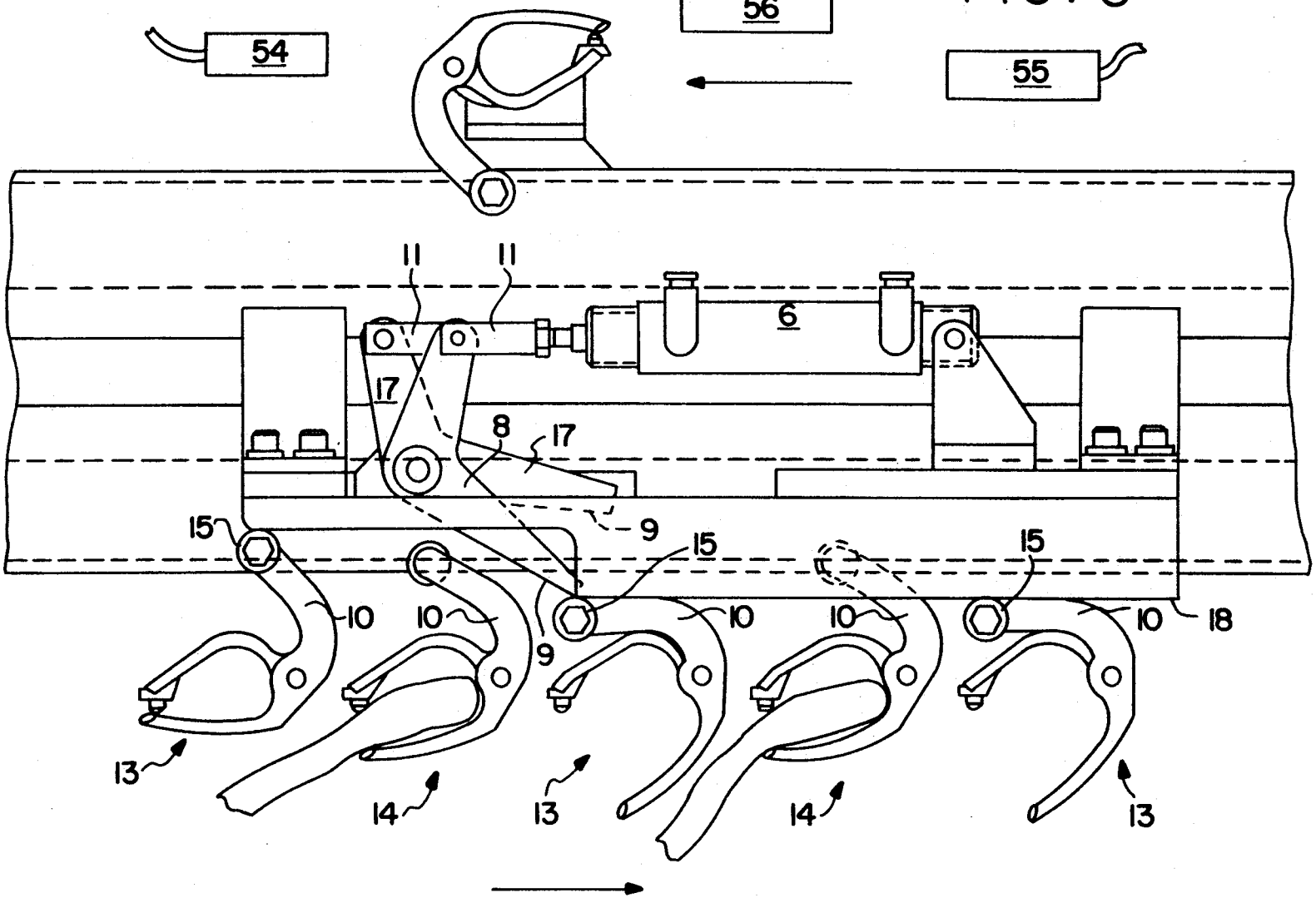
FIG. 3 is a view similar to that of FIG. 1 wherein alternate grippers are released.
Figure 4:
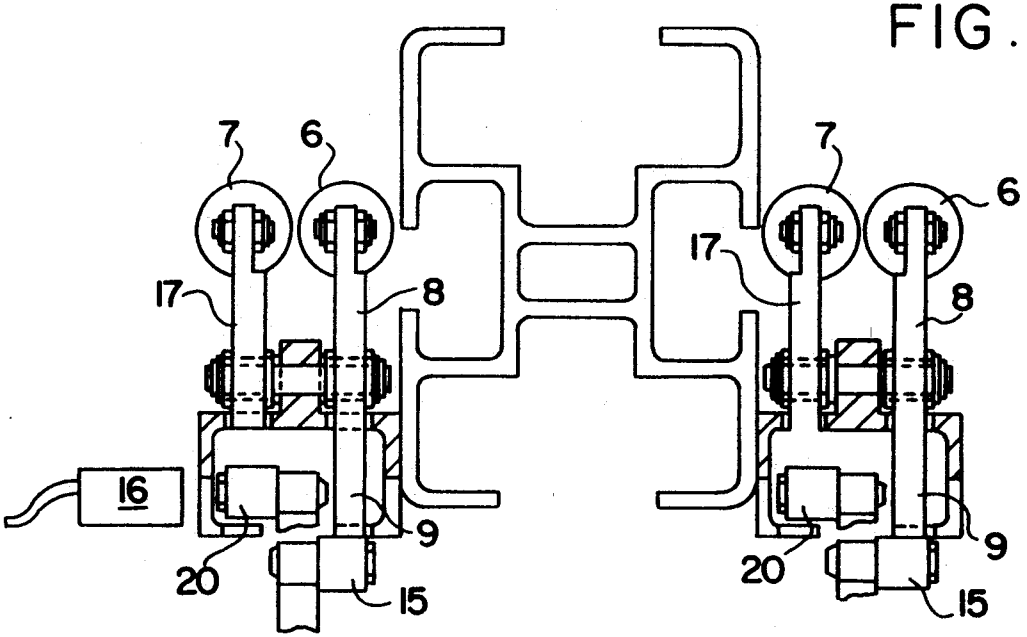
FIG. 4 is a view similar to that of FIG. 2, based on FIG. 3.

In FIGS. 3 and 4, the device is shown operating to release alternate grippers. In this case, solenoids 7 and rocker cams 17 are in their inactive positions. Thus, rollers 20 are not contacted by surface 9 and remain in their closed position. They ride on top of cam surface 18 as shown in the leading second alternate gripper 14 in FIG. 3. Solenoids 6 have been activated and are, along with rocker cams 8, in their operative positions. Cam surface 9 has contacted rollers 15 (both are shown in FIG. 4) and rollers 15 now are held in open position by retaining cam 18. Second alternate grippers 14 may, if desired, be released at a later point in the travel of conveyor 1.

Figure 5:
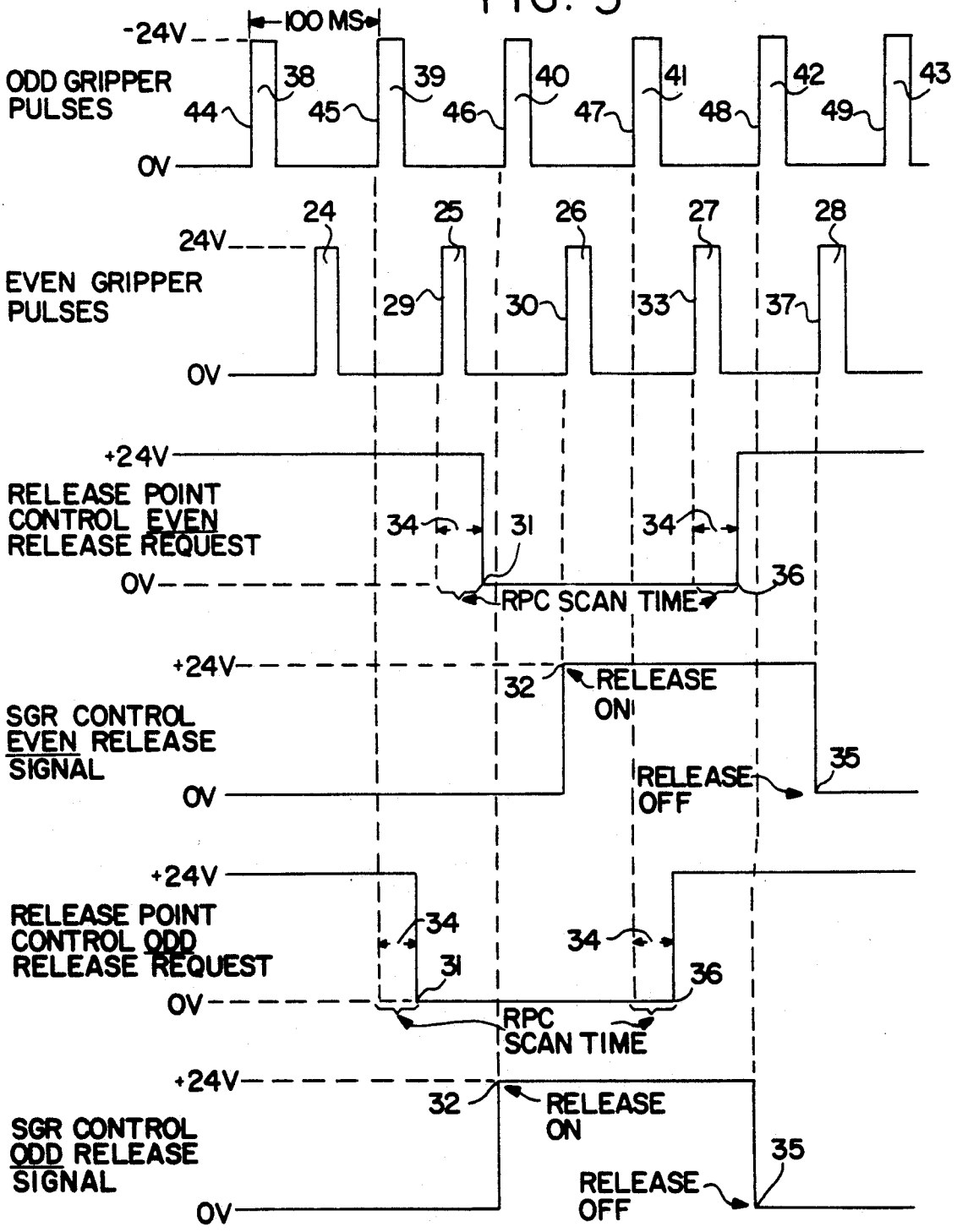
FIG. 5 is a diagrammatic view showing the timing of the various elements of the invention.
Figure 6:
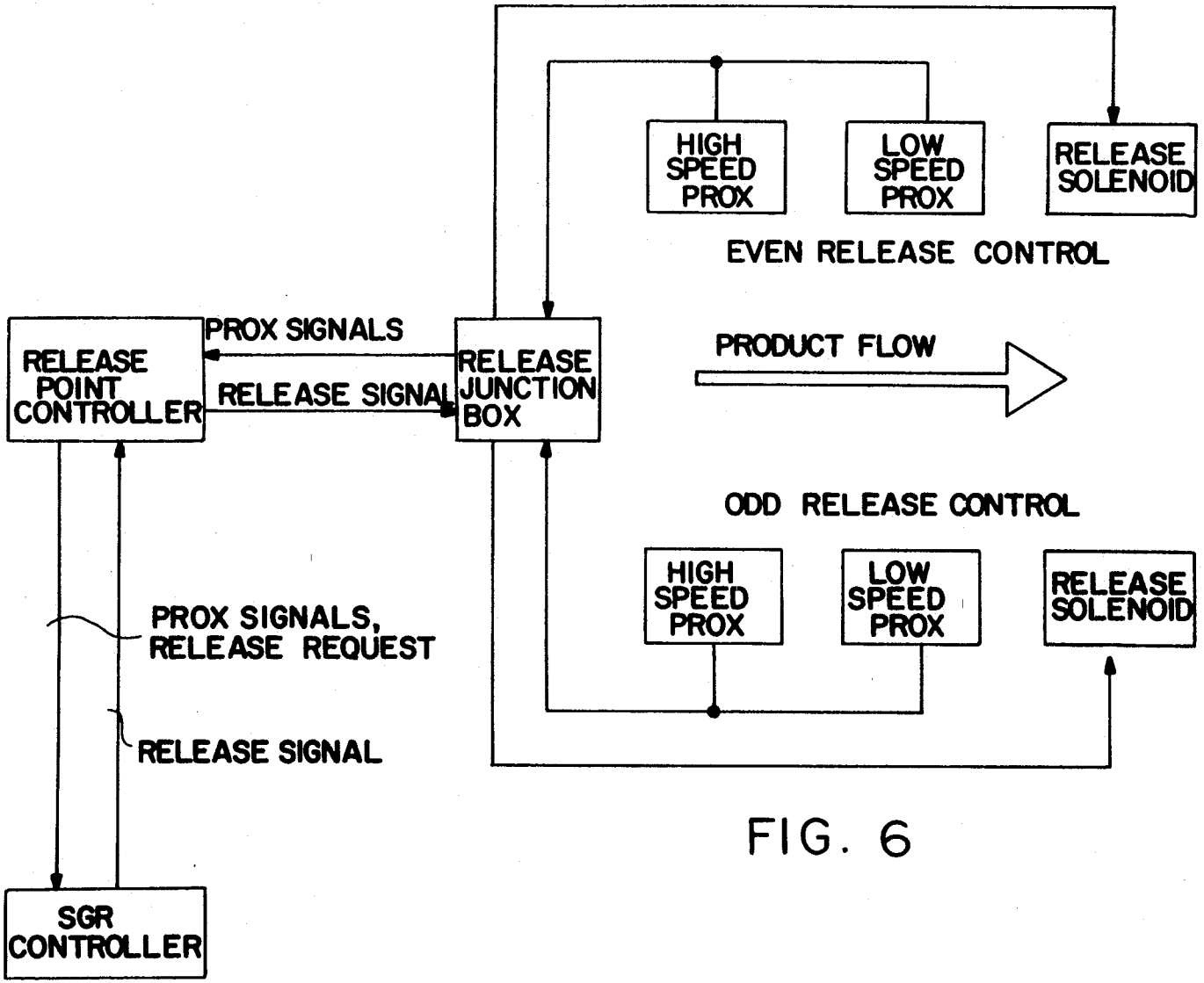
FIG. 6 is a schematic representation of the controllers and proximity switches.

First proximity switches 16 and 51 and second proximity switches 52 and 53 are provided adjacent rocker cams 8 and 17 to detect the presence of rollers 15 and 20. First alternate grippers 13 constitute the odd grippers and second alternate grippers 14 are the even grippers. The control and timing of actuation of solenoids 6 and 7 are shown diagrammatically in FIG. 5. Proximity switches 16 upon registering the presence of an odd gripper send pulses 38, 39, 40, 41, 42, and 43 to the release point control. Proximity switches 52 and 53 send even gripper pulses 24, 25, 26, 27, and 28 to the release point control. Assuming that there is a request to discharge the newspapers from the even grippers, leading edge 29 of gripper pulse 25 is detected by first release point control 54. Scan time 34 is required for gripper release control 56 to recognize that pulse 25 is that of an even gripper. At release point 31, it then signals the gripper release control which is programmed so that two conditions must be fulfilled before it is activated. First, it must receive the release point signal from the release point control and, second, it must register the leading edge 30 of the next even gripper pulse 26. Since the scan time of the gripper release control is on the order of 1 millisecond, the reaction time is virtually non existent. The fulfillment of the second condition causes the gripper control to activate the release signal and send it to the appropriate solenoids. This signal continues until inactivation point 35. The cycle is repeated as desired. The release of the odd gripper pulses is carried out, in exactly the same way. Leading edge 45 of pulse 39 is received by second release point control 55 and scan time 34 is required for recognition. At release point 31, a signal is sent to the gripper control which then awaits the next odd pulse, namely, leading edge 46 of pulse 40. In the same manner as for the release of the even grippers, solenoids 7 are activated by signal 32. They are held in open position until inactivation point 35. The relationships between the various elements of the electronic control system are diagrammed and described in FIG. 6.

Thus, the present invention provides a means for selectively releasing grippers, which does not require high speed mechanical equipment which is likely to be unreliable. It is possible to release the newspapers virtually at will and substantially without any misses or errors. They can be released singly, alternately, or entirely as is desired by the operator.

Although only a limited number of specific embodiments of the present invention have been expressly disclosed, it is, nonetheless, to be broadly construed and not to be limited except by the character of the claims appended hereto.

What we claim is

1. A release for a first gripper moving on a conveyor in a traveling direction, said first gripper comprising a first gripper arm and a second gripper arm, said first gripper arm and said second gripper arm being movable toward each other into a closed position, wherein said gripper exerts a clamping force on a planar product therebetween, and away from each other into an open position, wherein said gripper releases said product, a bias biasing said gripper toward said closed position, said first gripper adapted to move into said open position when a release force, greater than said clamping force, is applied thereto, at least one retaining cam adapted to retain said first gripper in said open position, at least one first rocker cam having an operative position, wherein said first rocker cam urges said gripper into said open position and into contact with said retaining cam, thereby holding said first gripper in said open position, and an inactive position, wherein it does not urge said gripper into said open position or into contact with said retaining cam, said rocker cam pivoting about a point intermediate its ends between said operative position and said inactive position.

2. The release of claim 1 comprising at least one first release arm on said first gripper which is adapted to receive said release force and transmit said release force to said first gripper.

3. The release of claim 1 wherein said first gripper arm is stationary and said second gripper arm is movable.

4. The release of claim 2 wherein said first release arm has a first release roller adjacent its distal end, said first release roller adapted to receive said release force and transmit said release force to said first release arm.

5. The release of claim 1 comprising an actuating cylinder adapted to move said first rocker cam between said operative position and said inactive position.

6. The release of claim 1 comprising a proximity switch adjacent said rocker cam adapted to sense the presence of said release arm and send a proximity signal to a controller which is adapted to activate said actuating cylinder.

7. A release for a first gripper moving on a conveyor in a traveling direction, said first gripper comprising a first gripper arm and a second gripper arm, said first gripper arm and said second gripper arm being movable toward each other into a closed position, wherein said gripper exerts a clamping force on a planar product therebetween, and away from each other into an open position, wherein said gripper releases said product, a bias biasing said gripper toward said closed position, said first gripper adapted to move into said open position when a release force, greater than said clamping force, is applied thereto, at least one retaining cam adapted to retain said first gripper in said open position, at least one first rocker cam having an operative position, wherein said rocker cam urges said gripper into said open position and into contact with said retaining cam, thereby holding said first gripper in said open position, at least one first release arm on said first gripper which is adapted to receive said release force and transmit said release force to said first gripper, a first pair of said first release arms, one of each side of said first gripper, a first pair of said first rocker cams, one adapted to bear against each of said release arms, and two said retaining cams, one adapted to retain said first release arms and said first gripper in said open position.

8. The release of claim 7 wherein there is a first pair of actuating cylinders adapted to move said first pair of rocker cams between said operative position and said inactive position.

9. The release of claim 7 wherein each of said first pair of release arms has a release roller at its distal end, each said release roller adapted to receive said release force and transmit said release force to its corresponding release arm, each of said rocker cams, when in said operative position, adapted to bear against one of said pair of release rollers, thereby to direct each said roller into one of said retaining cams.

10. The release of claim 9 wherein there is a first gripper followed by a second gripper, a first pair of said release rollers on said pair of release arms on said first gripper, said first pair of release rollers projecting in a first direction which is transverse to said traveling direction, a second pair of said release rollers on said pair of release arms on said second gripper, said second pair of release rollers projecting in a second direction which is transverse to said traveling direction and different from said first direction, said first pair of said first rocker cams adapted to bear against said first pair of release rollers when in said operative position, and a second pair of rocker arms adapted to bear against said second pair of release rollers when in said operative position.

11. The release of claim 10 wherein said first direction is opposite to said second direction.

12. The release of claim 10 wherein there is a first pair of actuating cylinders adapted to move said first pair of rocker cams between said operative position and said inactive position, a second pair of actuating cylinders adapted to move said second pair of rocker cams between said operative position and said inactive position.

13. The release of claim 7 comprising a first pair of said proximity switches, each adjacent one of said first pair of rocker cams, one said proximity switch adapted to sense the presence of each of said pair of release arms and send a proximity signal to a controller which is adapted to activate one of said actuating cylinders.

14. The release of claim 7 comprising said first gripper followed sequentially by a second gripper, a second pair of release arms, one on each side of said second gripper, a second pair of said rocker cams, one adapted to bear against each of said second pair of gripper arms, and a second retaining cam adapted to hold said second gripper and said second release arm in said open position.

15. The release of claim 14 comprising a first pair of said actuating cylinders, each adapted to move one of said first pair of rocker cams between said operative position and said inactive position, and a second pair of said actuating cylinders, each adapted to move one of said second pair of rocker cams between said operative position and said inactive position.

16. The release of claim 15 comprising a first proximity switch adjacent one of said first pair of rocker cams and adapted to sense the presence of one of said first pair of release arms and emit a first proximity signal based thereon, a second proximity switch adjacent one of said second pair of rocker cams and adapted to sense the presence of one of said second pair of release arms and emit a second proximity signal based thereon, a first release point control adapted to receive said first proximity signal and said second proximity signal and to distinguish therebetween, said first release point control adapted to send a first corresponding signal based on said first proximity signal to a gripper release control, said gripper release control adapted to receive said first corresponding signal and receive a first release control signal which directs release of said first gripper, said gripper control adapted to send a first operating signal to said first pair of actuating cylinders whereby said first gripper is released.

17. The release of claim 14 comprising a plurality of said first grippers and a plurality of said second grippers, said first grippers alternating with said second grippers.

18. The release of claim 16 comprising a plurality of said first grippers and a plurality of said second grippers, said first grippers alternating with said second grippers.

19. The release of claim 16 wherein said first release point control sends said first corresponding signal based on a first proximity signal in advance of the first proximity signal which corresponds to said first gripper to be released.

20. The release of claim 16 wherein a second release point control is adapted to send a second corresponding signal based on said second proximity signal to said gripper release control, said gripper release control adapted to receive said second corresponding signal and receive a second release control signal which directs release of said second gripper, said gripper control adapted to send a second operating signal to said second pair of actuating cylinders whereby said second gripper is released.

21. The release of claim 20 comprising a plurality of said first grippers and a plurality of said second grippers, said first grippers alternating with said second grippers.

22. The release of claim 20 wherein said first release point control is adjacent said second release point control.

23. The release of claim 20 wherein said first release point control and said second release point control are a single release control.

24. The release of claim 20 wherein said second release point control sends said second corresponding signal based on a second proximity signal in advance of the second proximity signal which corresponds to said second gripper to be released.

* * * * *